US007131162B2

(12) United States Patent
Anderson

(10) Patent No.: US 7,131,162 B2
(45) Date of Patent: Nov. 7, 2006

(54) FLOOR AND CARPET PUSH BRUSH

(75) Inventor: Thomas R. Anderson, Olmsted Township, OH (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 10/935,636

(22) Filed: Sep. 7, 2004

(65) Prior Publication Data

US 2006/0048316 A1 Mar. 9, 2006

(51) Int. Cl.
*A46B 9/02* (2006.01)
*A47L 11/32* (2006.01)

(52) U.S. Cl. ..... 15/106; 15/159.1; 15/41.1; 15/47; 15/49.1; 15/52.1

(58) Field of Classification Search ..... 15/41.1, 15/47, 49.1, 52.1, 106, 159.1, 160, DIG. 6
See application file for complete search history.

(56) References Cited

U.S. PATENT DOCUMENTS 1,564,526 A * 12/1925 Callais ..... 15/207.2
2,043,758 A * 6/1936 Lay ..... 15/159.1
4,422,202 A * 12/1983 Malvasio ..... 15/106
4,831,678 A * 5/1989 Dietsche ..... 15/176.4
5,537,707 A * 7/1996 Middleton ..... 15/106
5,707,454 A * 1/1998 Middleton ..... 134/6
6,311,354 B1 11/2001 Whittaker et al.
6,321,405 B1 11/2001 Whittaker et al.

* cited by examiner

*Primary Examiner*—Mark Spisich
(74) *Attorney, Agent, or Firm*—Pearne & Gordon LLP

(57) ABSTRACT

In a wheel supported floor and carpet push brush of the type having an array of aggressive bristles and another array of bristles which are of lesser diameter than the aggressive bristles carried on the dowel so that the brush can be turned over to bring a selected one of the arrays into operative sweeping position, the improvement wherein the average diameter of the aggressive bristles is no greater than about 0.012 inches with a preferred diameter being about 0.010 inches, and the other array of bristles have an average maximum diameter less than 0.010 inches with a preferred diameter being about 0.008 inches.

2 Claims, 5 Drawing Sheets

FLOOR AND CARPET PUSH BRUSH

TECHNICAL FIELD

The present invention relates generally to brush cleaners, and more specifically to a handled push brush useful for cleaning carpets and hard surfaces and for applying a carpet cleaning agent.

BACKGROUND OF THE INVENTION

Handled floor and carpet push brush cleaners have been devised in the past. Two such brush cleaners are disclosed in U.S. Pat. Nos. 6,311,354 and 6,321,405. Another known push brush cleaner of the general type disclosed in these patents consists of a wheel mounted spindle or dowel having two arrays of bristles, each consisting of several longitudinally extending rows. The bristles of one array have a larger diameter than the bristles in the other array. In use, the push broom is operatively positioned so that one of the two arrays is in sweeping contact with the floor or carpet. When desired, the push brush can be turned over to place the other bristle array in contact with the floor or carpet. With the selected array in operative position, the push brush is pushed and pulled across the surface to dislodge debris from the carpet or tile grouting, etc. The array of large diameter bristles penetrate deep into the carpet fibers, while the smaller diameter bristle array is useful on hard surfaces and carpets with shallow pile. When applying a cleaning agent, such a dry powder, to a carpet surface, the array of smaller diameter fibers can be used to smooth the agent over the carpet, while the array of larger diameter fibers can be used to push the agent deep into the carpet pile.

Known push brush cleaners of the type described have a disadvantage of requiring considerable effort to push the broom across the carpet. As a result, these push brooms have not been widely accepted in the market place.

Another disadvantage of the known floor and carpet push brooms is that the length of the bristle extension beyond the wheel periphery is limited. This limitation makes it impossible to maximize the cleaning ability of the broom on tile and the like. The amount of bristle extension needed for the best cleaning efficiency increases the force required to push the broom across the carpet to a level that makes the broom nearly impossible to use.

SUMMARY OF THE INVENTION

An object of the present invention is to provide a new and improved floor and carpet push broom which can be applied to carpet with considerably less operating force than required to push prior art brooms of the same type.

Another object of the invention is to provide a new and improved floor and carpet push broom which, in addition to be easier to use than prior art constructions, has longer bristle extensions than heretofore possible, thereby making the new broom more effective in cleaning floors, including tile floors.

As used herein, the term "bristle extension" means the distance the bristles of the broom project beyond the peripheries of the supporting wheels. The term "aggressive bristles" or "aggressive bristle array" refers to the bristles of greatest diameter. The term "normal bristles" or "normal bristle array" refers to the bristles which are smaller in diameter than the aggressive bristles. The term "aggressive position" refers to the operating position of the push broom in which the aggressive bristles are in sweeping contact with the surface to be cleaned. The term "normal position" refers to the operative position of the push broom in which the normal bristles are in sweeping contact with the surface to be cleaned.

As described above, the present invention particularly relates to a floor and carpet push broom which includes a cylindrical dowel, an array of aggressive bristles arranged in longitudinally extending rows along the length of the dowel, and an array of normal bristles arranged in longitudinally extending rows, the two arrays forming two arcuate, circumferentially spaced surface cleaning areas. Wheels are rotatably attached to the ends of the dowel and a telescopically extendable handle also is attached to the dowel.

In accordance with the invention, the aggressive bristles forming the aggressive array have an average diameter less than 0.012 inches, and, more preferably, an average diameter of about 0.010 inches. The normal bristles have an average diameter less than 0.010 inches, and, more preferably, have an average diameter of about 0.008 inches. While bristles having diameters less than that indicated can be used, the smaller diameter bristles will reduce the cleaning efficiency of the push broom because of their flexibility.

A further feature of the invention relates to the bristle extension. It has been found that the bristle extension can be as long as about 0.187 inches or slightly longer without increasing the force required to push the broom to an unacceptable level. Bristles of this length assure a good cleaning action when the push broom is applied to floors and carpets. Because of the construction of prior art push brooms, the bristle extension was limited to about 0.140 inches.

Other features and a fuller understanding of the invention will be had from the following detailed description and the accompanying drawings.

DESCRIPTION OF PREFERRED EMBODIMENTS

Figure 1:
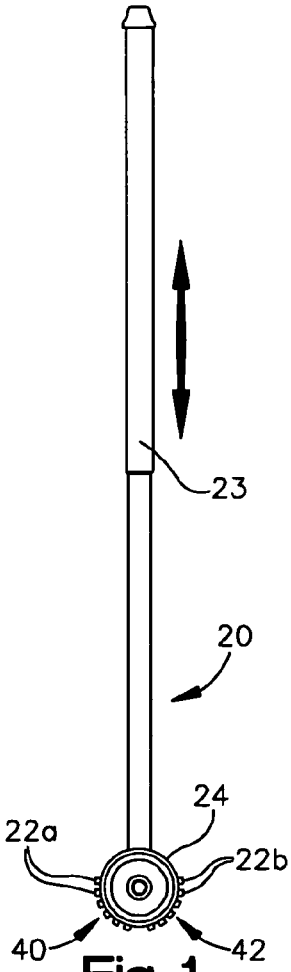
FIG. 1 is an elevational view of a floor and carpet push broom embodying the present invention.
Figure 2:
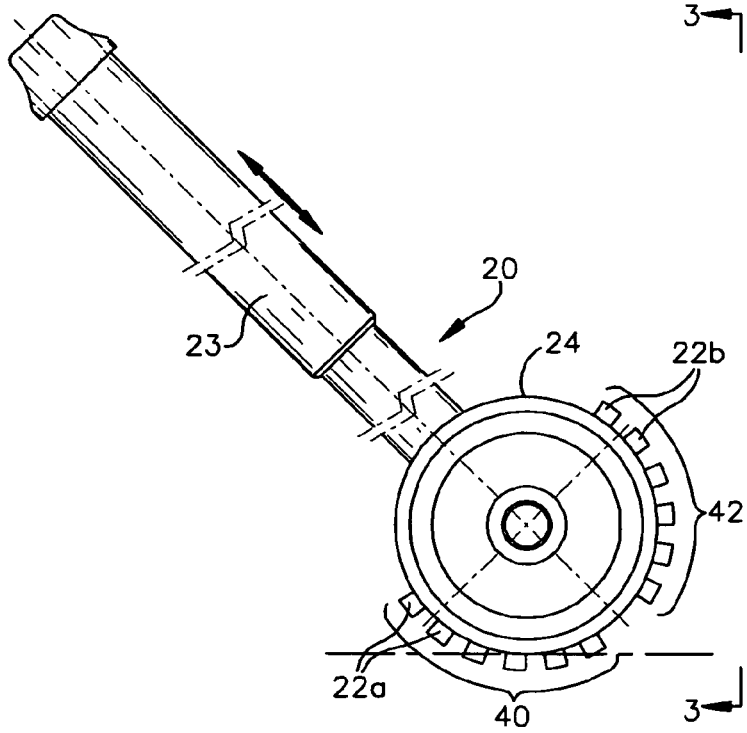
FIG. 2 is an enlarged and foreshortened elevational view of the push broom in an operative position.
Figure 3:
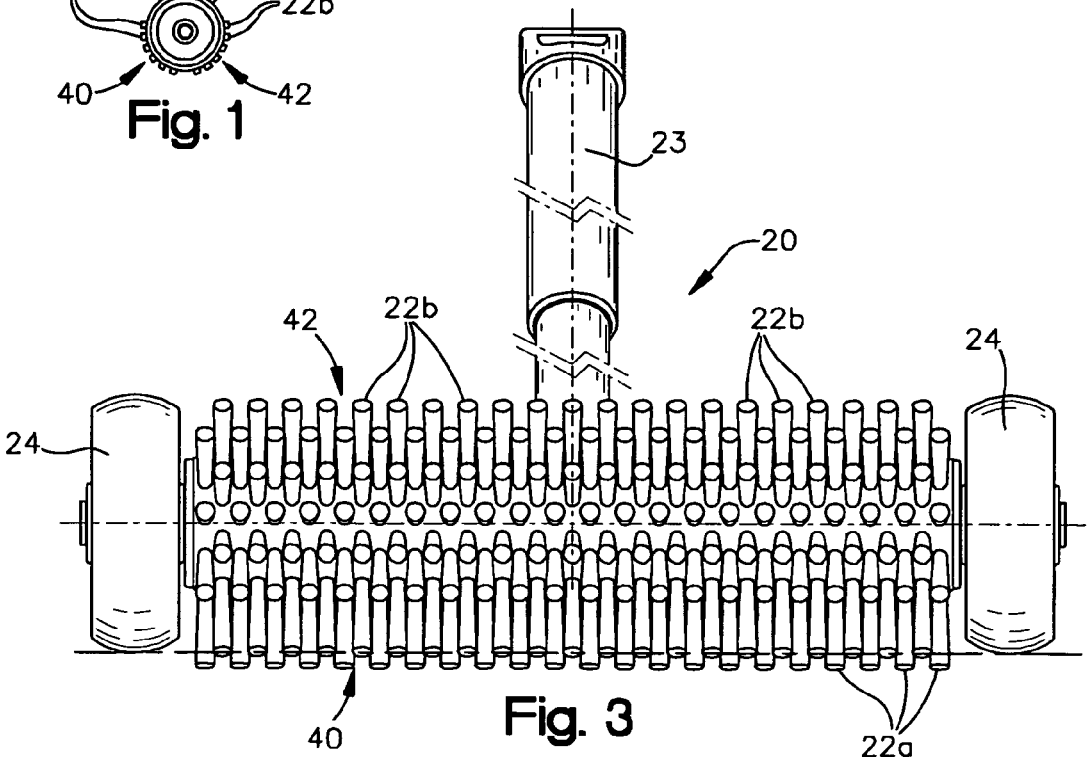
FIG. 3 is an elevational view taken in the plane of the line 3—3 in FIG. 2.

Referring now to the drawings, a floor and carpet push broom embodying the present invention is generally designated by reference numeral 20 in FIGS. 1–4. The illustrated push broom 20 comprises a dowel 21 to which several rows of longitudinally extending bristles 22 are attached. The push broom 20 further includes a telescopically extendable handle 23 and wheels 24 rotatably attached to the ends of the dowel 21.

Figure 4:
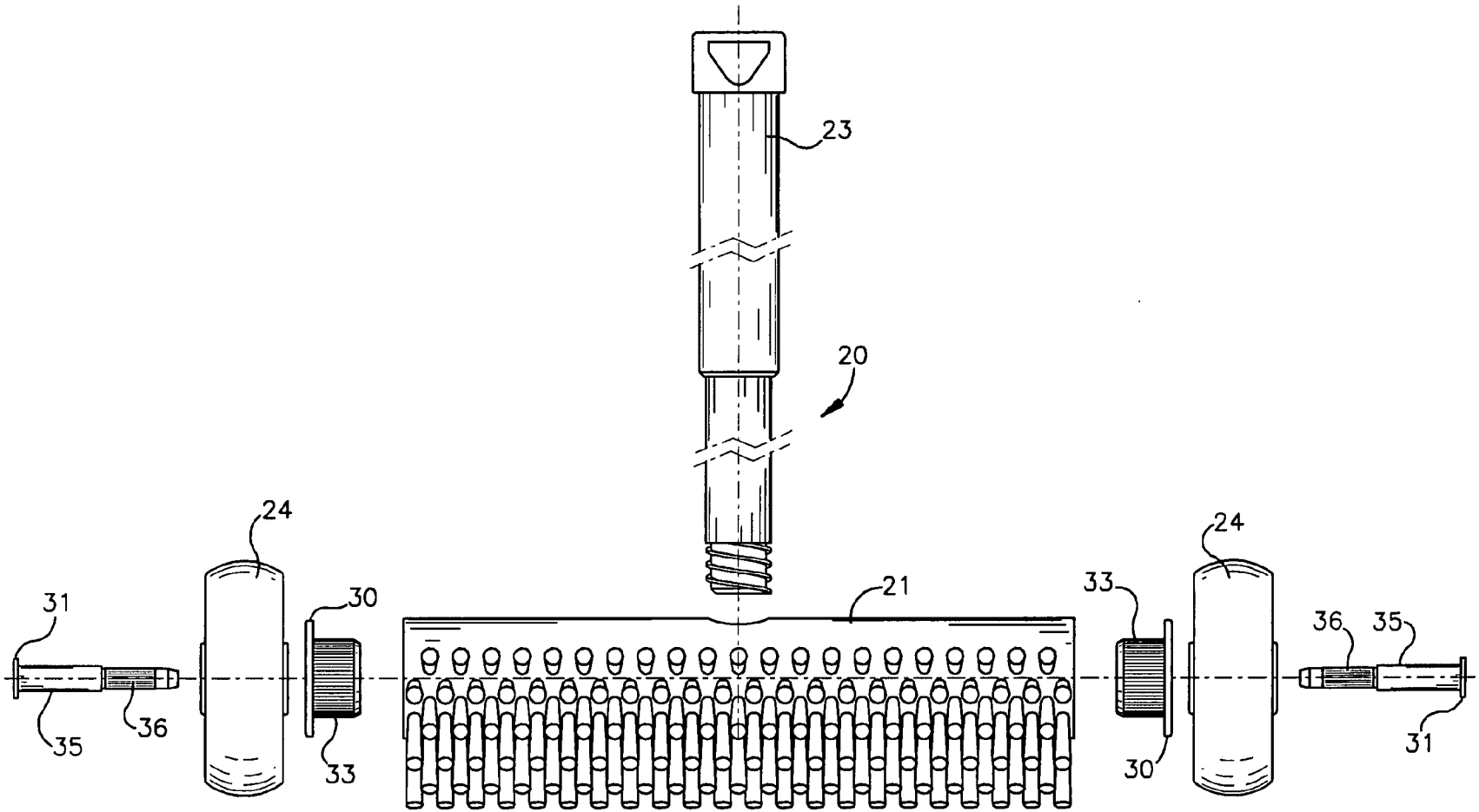
FIG. 4 is an exploded elevational view of the push broom.

As shown in FIG. 4, each of the wheels 24 is mounted by a plastic pin 30 and a steel pin 31. The pins 30 are inserted into holes (not shown) in the ends of the spindle 21 and have a splined outer periphery 33 that prevents rotation of the pins 30 in the spindle ends. The steel pins 31 are inserted through the wheels 24 into the pins 30. The wheels 24 rotate on the shanks 35 of the pins 31. The end portions 36 of the pins 31 have splines which engage in the plastic pins 30 so as to prevent relative rotation.

The bristles 22 are arranged in an aggressive array 40 and a normal array 42. Each array of bristles presents an arcuate surface cleaning area extending along the dowel length. In use, the push broom 20 is placed in an operative position in which the cleaning area of a selected one of the arrays, for example, the array 40, contacts the surface to be cleaned. The broom is then pushed across the surface to clean it. The other array 42 can be placed into cleaning position simply by turning the broom 20 over.

The push broom as described and illustrated has been selected merely for the purpose of showing the general construction in which the invention has useful application. It will be understood by those skilled in the art that the details of the disclosed construction is not limiting of the invention and is subject to variation, such as the handle structure 23, the way of mounting the wheels 24, etc.

In accordance with the invention, the average bristle diameter of the aggressive bristle array 40 is less than 0.012 inches, and, more preferably, is about 0.010 inches. The average bristle diameter of the normal bristle array 42 is less than 0.010 inches, and, more preferably, is about 0.008 inches. A preferred bristle extension is about 0.187 inches, although the bristle extension could be less if desired. Smaller bristle extensions will decrease the cleaning efficiency of the push brush on some floors.

The improvements resulting from bristle arrays according to this invention, i.e., a marked reduction in the force required to push a floor and carpet push broom across a carpet, was demonstrated by a series of tests using a pushability testing machine built to ASTM specification F1409-94 entitled "Standard Test for Straight Line Movement of Cleaners for Cleaning Carpet". In conducting the tests, the force required to push each push broom with its aggressive and normal bristle arrays in contact with a plush carpet was measured through three pushing strokes for each array. The three brushes tested had bristle sizes as follows:

Brush No. 1
Average aggressive bristle diameter 0.016 inches;
Average normal bristle diameter 0.012 inches; and
Bristle extension 0.140 inches.

Brush No. 2
Average aggressive bristle diameter 0.012 inches;
Average normal bristle diameter 0.008 inches; and
Bristle extension 0.187 inches.

Brush No. 3
Average aggressive bristle diameter 0.010 inches;
Average normal bristle diameter 0.008 inches; and
Bristle extension 0.187 inches.

Figure 5:
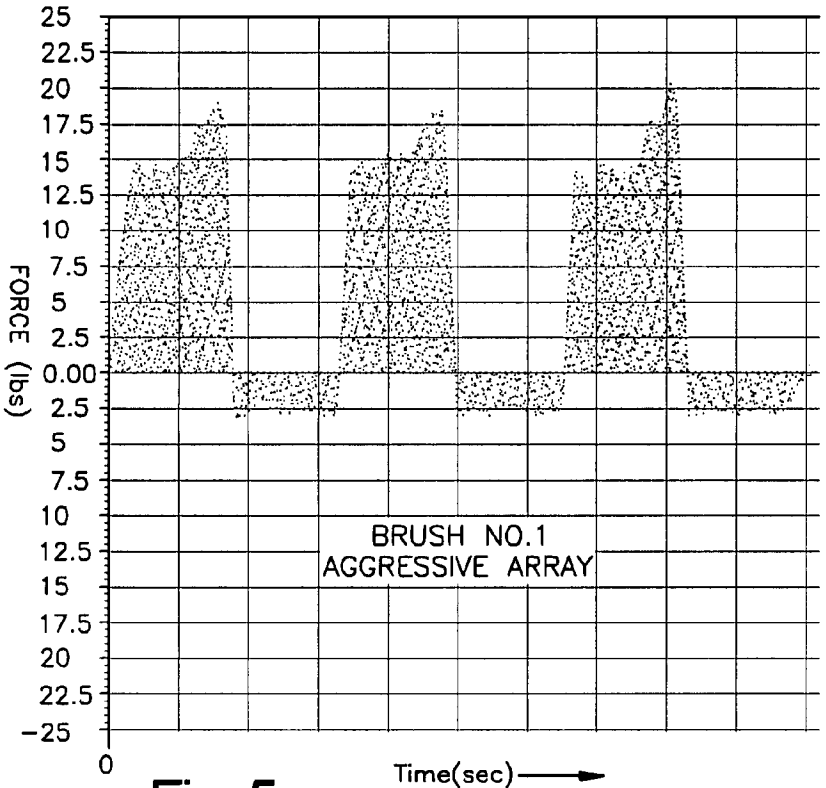
Fig. 5 (PRIOR ART)
FIGS. 5–10 are graphs showing the force required to push brooms having various bristle diameters and bristle extensions more particularly described below.
Figure 6:
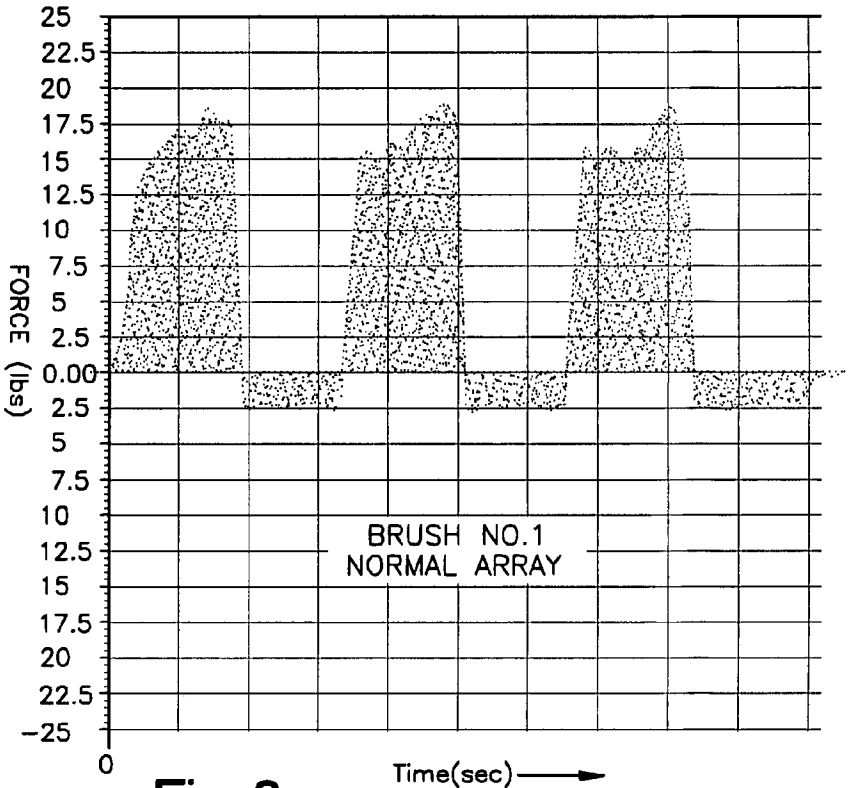
Fig. 6 (PRIOR ART)

Brush No. 1 is representative of the prior art. The forces required to push brush No. 1 with its aggressive and normal bristle arrays in contact with the carpet are graphically shown in FIGS. 5 and 6, respectively. Each of the pushing strokes of the aggressive array (FIG. 5) had a time duration of about 1.43 seconds, and each of the pushing strokes of the normal array (FIG. 6) took place in about 1.44 seconds.

Figure 8:
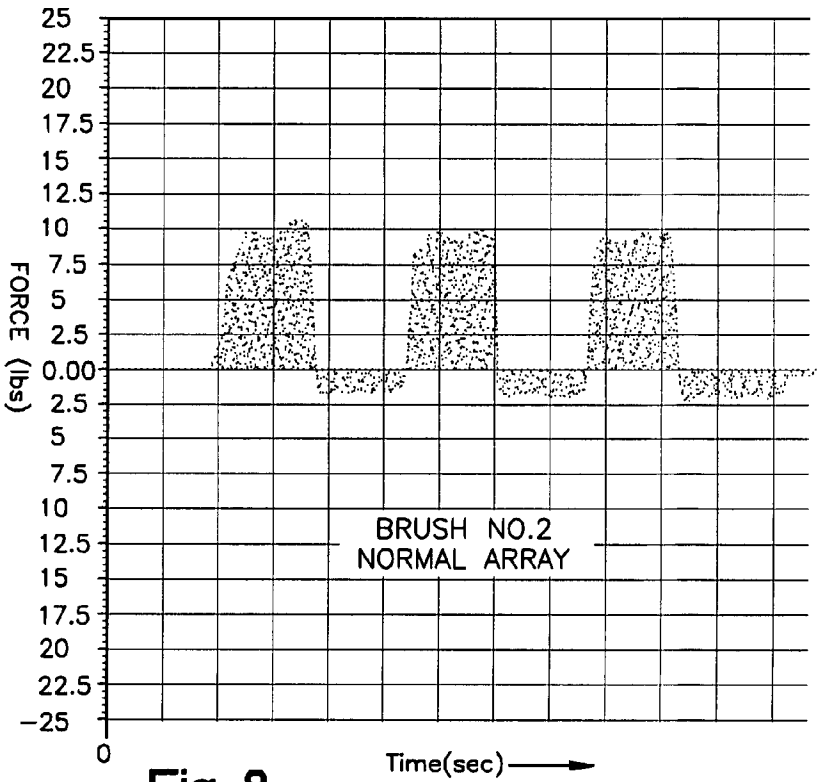
Figure 7:
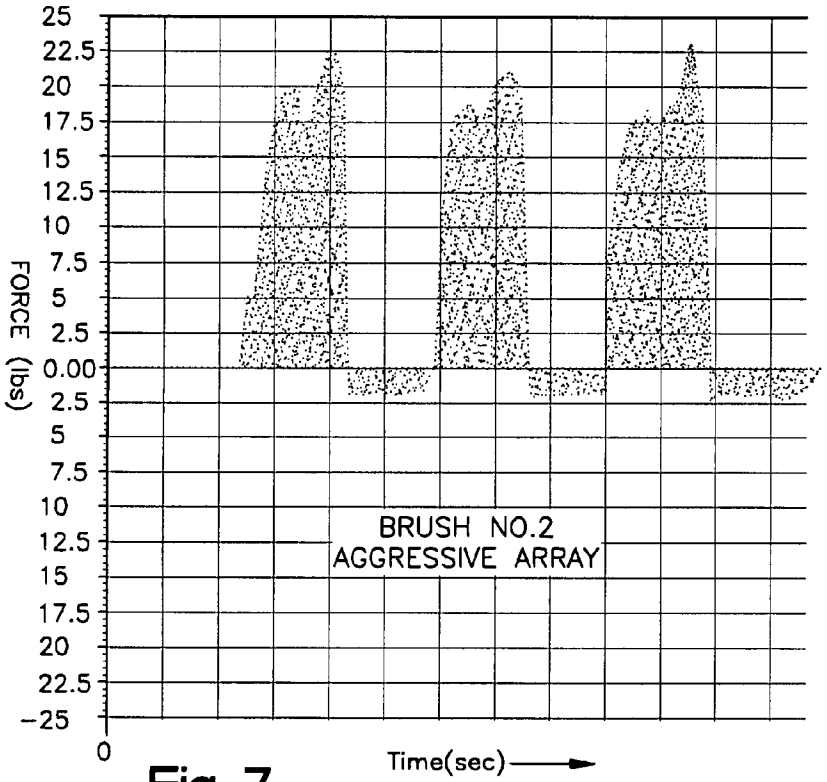

The forces required to push brush No. 2 with its aggressive and normal bristle arrays in contact with the carpet are graphically shown in FIGS. 7 and 8, respectively. Each of the pushing strokes of the aggressive array (FIG. 7) took about 2.09 seconds, and each of the pushing strokes of the normal bristle array (FIG. 8) took place in about 2.07 seconds.

Brush No. 3 is constructed according to the present invention. The forces required to push this brush with its aggressive and normal bristle arrays in contact with the carpet are graphically shown in FIGS. 9 and 10, respectively. The pushing strokes of the aggressive array (FIG. 9) took about 1.56 seconds, while each of the pushing strokes of the normal array (FIG. 10) took about 1.44 seconds.

The graphic results of the pushability tests for each brush on the forward strokes are set out in the following tables:

TABLE 1

Brush No. 1

| | Aggressive Array (Force in Pounds) | | | Normal Array (Force in Pounds) | | |
|---|---|---|---|---|---|---|
| | Peak | Bottom | Average | Peak | Bottom | Average |
| Stroke 1 | 18.5 | 13.5 | 16.00 | 18.5 | 15.0 | 16.75 |
| Stroke 2 | 18.5 | 13.5 | 16.00 | 18.5 | 15.0 | 16.75 |
| Stroke 3 | 20.0 | 13.5 | 16.75 | 18.5 | 14.5 | 16.50 |
| Averages | 19.0 | 13.5 | 16.25 | 18.5 | 14.83 | 16.67 |

TABLE 2

Brush No. 2

| | Aggressive Array (Force in Pounds) | | | Normal Array (Force in Pounds) | | |
|---|---|---|---|---|---|---|
| | Peak | Bottom | Average | Peak | Bottom | Average |
| Stroke 1 | 22.75 | 16.75 | 19.75 | 10.75 | 9.0 | 9.875 |
| Stroke 2 | 21.5 | 17.0 | 19.25 | 10.0 | 9.0 | 9.5 |
| Stroke 3 | 23.0 | 16.75 | 19.875 | 9.5 | 9.0 | 9.25 |
| Averages | 22.41 | 16.83 | 19.625 | 10.08 | 9.0 | 9.542 |

TABLE 3

Brush No. 3

| | Aggressive Array (Force in Pounds) | | | Normal Array (Force in Pounds) | | |
|---|---|---|---|---|---|---|
| | Peak | Bottom | Average | Peak | Bottom | Average |
| Stroke 1 | 12.75 | 11.25 | 12.0 | 7.5 | 6.5 | 7.0 |
| Stroke 2 | 12.0 | 11.0 | 11.5 | 7.25 | 6.5 | 6.875 |
| Stroke 3 | 12.0 | 11.0 | 11.5 | 7.5 | 6.5 | 7.0 |
| Averages | 12.25 | 11.083 | 11.667 | 7.41 | 6.5 | 6.958 |

It will be seen that the force required to push brush No. 1 with its aggressive array (average diameter of 0.016 inches and extension of 0.140 inches) increased from an average of 13.5 pounds at the start of the pushing stroke to an average peak value of 19 pounds at the end of the stroke, the overall pushing force averaging 16.25 pounds. This increase in pushing force is due to the fact that the brush bristles progressively dig into the carpet as the brush is moved through a pushing stroke. When brush No. 1 was turned over to place the normal bristle array (average diameter of 0.012 inches and extension of 0.140 inches) into operative position, the force required to move the brush increased from an average of 14.83 to an average peak of 18.50 pounds with the overall average being 16.67 pounds.

Brush No. 2 had smaller diameter bristles averaging 0.012 inches for the aggressive array and 0.008 for the normal array, but had the bristles extended to 0.187 inches. With this longer bristle extension which is desirable from the standpoint of good cleaning efficiency, the force required to move the aggressive array across the carpet increased from an average of 16.83 pounds to an average peak of 22.41 pounds with the overall average being 19.625 pounds. The force required to move the brush with the normal bristles in operating position increased from an average of 9.0 pounds to a peak average of 10.08 pounds with the overall average being 9.542 pounds. The very high actuating force required to move the aggressive bristle array through a pushing stroke makes this brush impractical. As explained above, the tests were conducted on a plush carpet. If the brush were used on a carpet having closed loop pile, the required actuating forces would be even greater than shown in the graphs and tables.

Brush No. 3 constructed according to the invention, significantly reduced the effort required to use the push broom and, at the same time, makes it possible to have a bristle extension of about 0.187 inches. With the aggressive array in operating position, the force required to move the brush across the carpet increased from an average of 11.083 pounds to an average peak of only 12.25 pounds with the overall average being 11.667 pounds. With the normal bristles in operating position, the force required to move the brush increased from an average of 6.5 pounds at the start of the pushing stroke to an average of 7.41 pounds at the end of the stroke with the overall average being about 6.958 pounds. As shown in Table 2, a bristle extension of 0.187 inches was entirely unsuitable in brush No. 2. The effort required to push brush No. 3 with its long bristle extension was considerably less than the effort required to push brush No. 1 with the shorter bristle extension of 0.140 inches.

Figure 10:
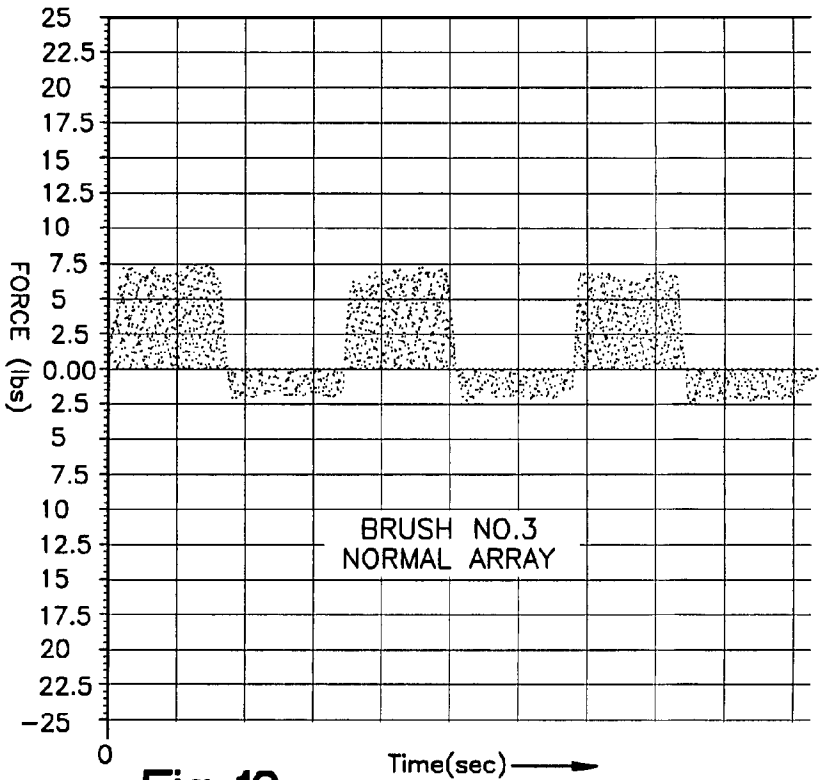
Figure 9:
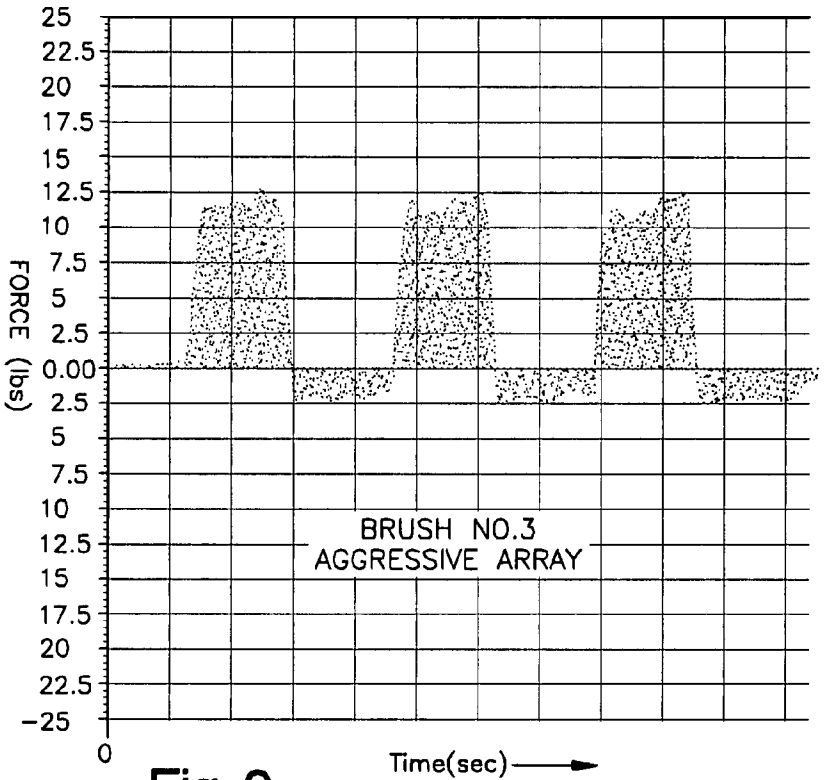

Another advantageous feature of brush No. 3 which is made apparent by FIGS. 9 and 10 is that a substantially constant force is required to move the brush from the start of a pushing stroke to the end of the stroke. The force required to push both the aggressive array and the normal array does not significantly peak at the end of the stroke as with the brushes 1 and 2. This feature contributes to the ease of working the brush across a carpet.

In summary, it will be seen that the objective of providing a floor and carpet push brush of the type described which can be easily used with minimum effort has been achieved. It will also be seen that this improvement is achieved in a brush having maximum bristle extension desired for efficiently cleaning floors such as tile and the like.

Variations and modifications of the invention will become apparent to those skilled in the art in light of the foregoing detailed disclosure. Therefore, it is to be understood that, within the scope of the appended claims, the invention can be practiced otherwise than as specifically shown and described.

The invention claimed is:

1. In a floor and carpet push brush having a cylindrical dowel, first and second arrays of cleaning bristles arranged in longitudinally extending rows so that the ends of the bristles define first and second, arcuate, circumferentially spaced surface cleaning areas along the dowel length, wheels rotatably attached to the ends of the dowel, and a handle attached to the dowel, the improvement wherein:

a) the bristles of said first array have an average maximum diameter no greater than about 0.010 inches, b) the bristles of said second array have an average maximum diameter which is less than the diameter of the bristles of said first array and is about 0.008 inches, and c) a bristle extension of about 0.187 inches.

2. In a floor and carpet push brush having a cylindrical dowel, two arrays of bristles arranged in longitudinally extending rows so that the ends of the bristles define first and second, arcuate, circumferentially spaced surface cleaning areas along the dowel length, wheels rotatably attached to the ends of the dowel, and a handle attached to the dowel, the improvement wherein:

a) the bristles of said first cleaning area have an average maximum diameter less than 0.012 inches, b) the bristles of said second cleaning area have an average diameter less than the average diameter of said bristles of said first cleaning area, and c) a bristle extension of about 0.187 inches.

* * * * *